US008047039B2

(12) United States Patent
Hidaka et al.

(10) Patent No.: US 8,047,039 B2
(45) Date of Patent: Nov. 1, 2011

(54) PROCESS FOR PRODUCING STAINLESS STEEL PIPE

(75) Inventors: Yasuyoshi Hidaka, Hyogo (JP); Satoshi Matsumoto, Osaka (JP); Toshihide Ono, Hyogo (JP); Kouji Nakaike, Wakayama (JP); Sumio Iida, Hyogo (JP); Hiroshi Nogami, Osaka (JP)

(73) Assignee: Sumitomo Metal Industries, Ltd., Osaka-shi (JP)

( * ) Notice: Subject to any disclaimer, the term of this patent is extended or adjusted under 35 U.S.C. 154(b) by 0 days.

(21) Appl. No.: 12/247,923

(22) Filed: Oct. 8, 2008

(65) Prior Publication Data

US 2009/0064749 A1 Mar. 12, 2009

Related U.S. Application Data

(63) Continuation of application No. PCT/JP2007/059072, filed on Apr. 26, 2007.

(30) Foreign Application Priority Data

Apr. 28, 2006 (JP) ..... 2006-126315

(51) Int. Cl.
*B21B 17/10* (2006.01)
*B21D 37/16* (2006.01)

(52) U.S. Cl. ..... 72/208; 72/202; 72/342.1

(58) Field of Classification Search ..... 72/200, 72/202, 208, 342.1, 367.1, 368, 370.01, 209
See application file for complete search history.

(56) References Cited

U.S. PATENT DOCUMENTS

2007/0287642 A1* 12/2007 Sasaki et al. ..... 508/158
2008/0011037 A1* 1/2008 Beppu ..... 72/208

FOREIGN PATENT DOCUMENTS

JP 59-037317 2/1984
JP 01-159321 6/1989

(Continued)

OTHER PUBLICATIONS

International Preliminary Report on Patentability from the International Bureau of WIPO, dated Nov. 17, 2008.

(Continued)

*Primary Examiner* — Debra Sullivan
(74) *Attorney, Agent, or Firm* — Marshall, Gerstein & Borun LLP

(57) ABSTRACT

A process for stainless-steel pipe production which comprises piercing rolling a raw material stainless steel containing, by mass, Cr: 10-30%, to give a hollow shell, elongating rolling the hollow shell using a mandrel bar, together with a graphite-free lubricant, to give a finishing rolling blank pipe and heating the blank pipe in a reheating furnace and subjecting the same to finishing rolling by sizing rolling to produce a hot-finished pipe, and then subjecting this pipe as a mother pipe to cold working to produce a stainless-steel pipe. In the reheating furnace, the finishing rolling blank pipe is heated to 1000° C. or more and subjected to heating in which an oxidizing gas is blown into the pipe inside, whereby a stainless-steel pipe which is inhibited from forming a carburized layer in the pipe inner surface can be produced. When the finishing rolling by sizing rolling to give a cold working mother pipe is carried out by stretch reducer rolling at 860-1050° C., an annealing heat treatment of the mother pipe for cold working can be omitted. Thus, a stainless-steel pipe having excellent surface quality can be efficiently produced.

4 Claims, 6 Drawing Sheets

FOREIGN PATENT DOCUMENTS

| | | |
|---|---|---|
| JP | 04-168221 | 6/1992 |
| JP | 08-57505 | 3/1996 |
| JP | 08-090043 | 4/1996 |
| JP | 09 078080 | 3/1997 |
| JP | 09-201604 | 8/1997 |
| JP | 2000-24706 | 1/2000 |

OTHER PUBLICATIONS

International Search Report in corresponding PCT/JP2007/068362 dated Jul. 17, 2007.
Written Opinion of the ISA in corresponding PCT/JP2007/068362 dated Jul. 17, 2007 in Japanese language only.

* cited by examiner

FIG. 6

(a) Hot-finished pipe

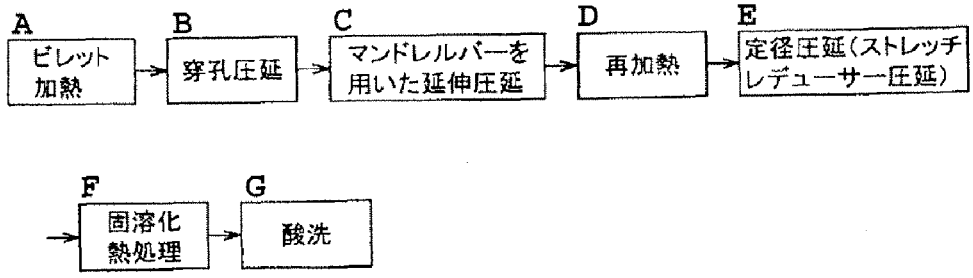

(b) Cold-finished pipe

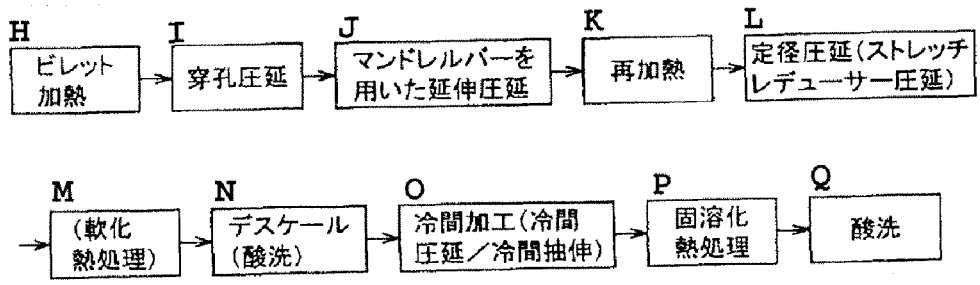

A: Billet heating
B: Piercing rolling
C: Elongating rolling using a mandrel bar
D: Reheating
E: Sizing rolling (stretch reducer rolling)
F: Solution heat treatment
G: Pickling
H: Billet heating
I: Piercing rolling
J: Elongating rolling using a mandrel bar
K: Reheating
L: Sizing rolling (stretch reducer rolling)
M: (Annealing heat treatment)
N: Descaling (pickling)
O: Cold working (cold rolling/cold drawing)
P: Solution heat treatment
Q: Pickling FIG.7
(a)
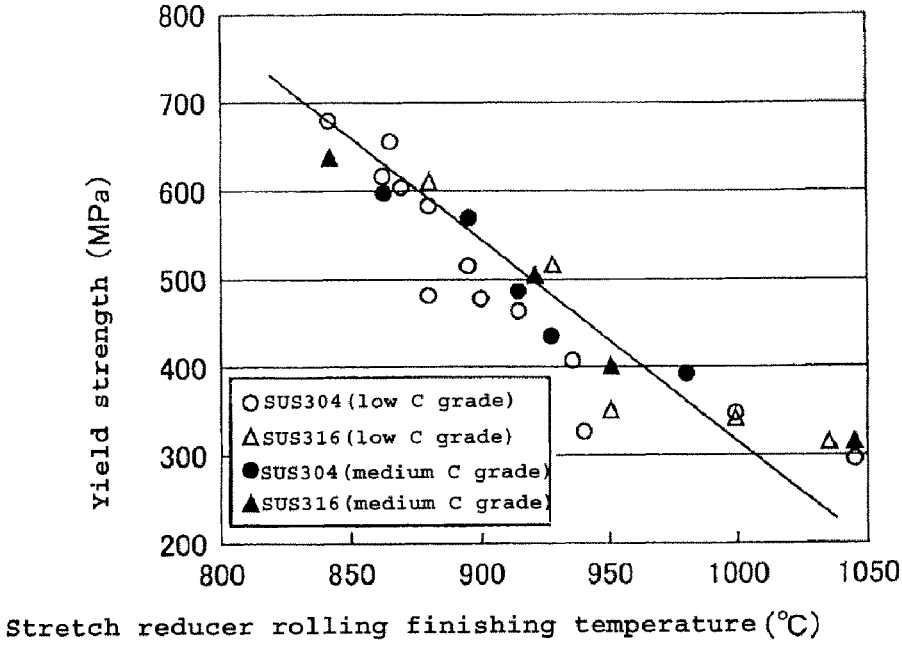
(b)
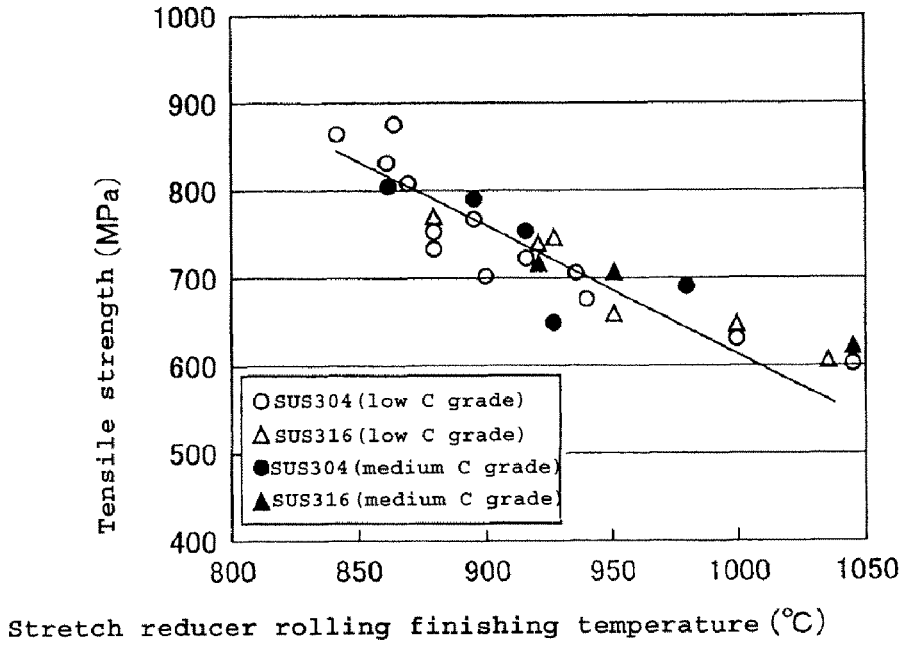

PROCESS FOR PRODUCING STAINLESS STEEL PIPE

TECHNICAL FIELD

The present invention relates to a process for producing a stainless steel pipe from a stainless-steel material via piercing rolling, elongating rolling using a mandrel bar and sizing rolling and, further, to a production process in which such stainless steel pipe, as a mother pipe, is cold-worked. More particularly, it relates to a process for producing a stainless steel pipe according to which the inner surface carburization to be generated in the step of elongating rolling using a mandrel bar, for example mandrel mill rolling, even when a graphite-free lubricant is used, can be inhibited and, when the thus-obtained pipe, as a mother pipe, is subjected to cold working, the annealing heat treatment thereof prior to cold working can be omitted.

BACKGROUND ART

The stainless steel pipe production process which comprises producing stainless steel pipes by carrying out the steps of piercing rolling, elongating rolling using a mandrel bar, for example mandrel mill rolling, and sizing rolling and, further, subjecting the thus-obtained pipes, as mother pipes, to cold working is widely applied. In the following, such production process is explained in connection with the case of applying mandrel mill rolling as elongating rolling and stretch reducer rolling as sizing rolling.

A round steel block (billet) is heated to a predetermined temperature (generally 1150-1250° C.) using a heating furnace, such as a rotary hearth type, and this billet is passed through an inclined roll type piercing/rolling machine for making a hollow shell. Then, a mandrel bar coated with a lubricant is inserted into the hollow shell and the hollow shell is subjected to a single-pass rolling on a mandrel mill composed of 7 to 9 stands for roughening rolling to give a finishing rolling blank pipe with predetermined dimensions.

After this roughening rolling, the blank pipe to be subjected to finishing rolling is fed to a reheating furnace and reheated (generally to 900-1000° C.), the pipe outer surface alone is descaled by injecting high-pressure water jet, and the blank pipe is passed through a stretch reducer rolling mill to give a hot-finished pipe. When a cold working step follows, the pipe is referred to as a cold working mother pipe.

In the above-mentioned process of rolling the hot-finished pipe or cold working mother pipe, the mandrel bar to be used in the step of roughening rolling on a mandrel mill is inserted into the hollow shell in a high-temperature condition (generally 1100-1200° C.), creating the chance of readily causing seizure onto the hollow shell. The pipe profile and wall thickness after mandrel mill rolling is influenced by the roll revolving speed and roll caliber profile in the rolling step and further by the friction between the mandrel bar and the hollow shell.

Therefore, for preventing the seizure of the mandrel bar onto the hollow shell and for making the friction with the hollow shell proper so as to obtain the desired pipe profile and wall thickness, a lubricant is applied to the outer surface of the mandrel bar.

Known as such lubricant is, for example, a water-soluble lubricant based on graphite, which is inexpensive and has very good lubricating properties, as described in Japanese Patent Publication No. 59-37317, and this graphite-based lubricant has so far been used frequently. However, when a stainless steel material containing 10-30% Cr by mass is used, roughening rolling using a mandrel bar coated with a graphite-based lubricant incurs the phenomenon of carburization during rolling and a carburized layer having a higher carbon concentration than that of the base material is formed on the pipe inner surface side.

During the subsequent steps of reheating and rolling on a stretch reducer and further during the heat treatment steps, namely in the annealing heat treatment of the mother pipe, which is carried out prior to cold working, and the solution treatment, which is carried out in the final step, the carbon concentration in the carburized layer generated in the pipe inner surface decreases as a result of diffusion of carbon into the base material; however, the depth of the carburized layer increases and a carburized layer having a high carbon concentration still remains.

The main cause of the formation of a carburized layer in the pipe inner surface is the ingress of CO gas into the inside of steel, the CO gas being formed by gasification of part of graphite which is the main component of the inner surface lubricant, and/or part of carbon in the organic binder used therein, during mandrel mill rolling. As a result, the carbon concentration in the portion spanning about 0.5 mm deep from the surface in a thickness-wise direction sometimes becomes higher by about 0.1% by mass than that of the base material, so that it may exceed the upper limit of C content specified in Standard or the like in some cases.

In the carburized layer remaining with the level exceeding the specified limit, Cr, which is the main element forming a passivation film, namely an anticorrosive film, in stainless steel, is immobilized in the form of carbides, so that the corrosion resistance of the pipe inner surface is markedly deteriorated.

Therefore, those seamless stainless steel pipes which were subjected to the formation of a carburized layer in the pipe inner surface, cannot be shipped as products in as-is condition, so that measures for diminishing the carburized layer are taken. For example, the pipe inner surface where a carburized layer remains is wholly polished or, in Japanese Patent Application Publication No. 09-201604, a special heat treatment method is proposed which comprises subjecting the pipe after finishing rolling to descaling so as to reduce the thickness of the oxidized scale layer in the pipe inner surface and then keep the same for 3-20 minutes in an oxidizing atmosphere at 1050-1250° C. for decarburization. However, these methods of causing the carburized layer portion to disappear have a problem in that enormous man-hours and considerable costs are required for the treatment.

Further, in Japanese Patent Application Publication No. 08-90043, a process for producing seamless stainless steel pipes is proposed in which the mandrel mill rolling step is applied using a graphite-based lubricant, comprising reheating the finishing rolling blank pipe after mandrel mill rolling, in which the blank pipe whose inside is filled with an atmosphere containing steam in an amount of not less than 10% by volume is reheated and then finishing-rolled and, thereafter, further subjected to solution heat treatment. However, the production process proposed in the above-cited publication requires a fairly large-scale steam production apparatus for continuously passing steam of 10% by volume or more through the pipe inside.

Further, Japanese Patent Application Publication No. 04-168221 proposes a process for producing austenitic stainless steel pipes which comprises subjecting a finishing rolling blank pipe as obtained by mandrel rolling using a graphite-based lubricant to finishing rolling after 10-30 minutes of retention thereof in an atmosphere having an oxygen concentration of 6-15% in a temperature range of 950-1200° C. However, the production process proposed in the above-cited publication is impracticable from the yield viewpoint since the scale loss is great due to a long period of time required for heating the finishing rolling blank pipe.

And, in Japanese Patent Application Publication No. 08-57505, a process for producing austenitic stainless steel pipes which comprises replacing the atmosphere gas inside the blank pipe, after hollow shell rolling on a mandrel mill using a graphite-based lubricant, with an oxidizing gas prior to feeding it into a reheating furnace and feeding the oxidizing gas into the hollow shell inside during heating in the furnace.

The production processes proposed in the above-cited Japanese Patent Application Publication No. 08-90043, 04-168221 and 08-57505 all attempt to inhibit pipe inner surface carburization by subjecting the blank pipe to finishing rolling, such as stretch reducer rolling, after mandrel mill rolling using a graphite-based lubricant, and to apply decarburization treatment in reheating; the use of a graphite-based lubricant, however, still leads to a large extent of carburization.

Therefore, the effect of decarburization by feeding an oxidizing gas is restricted. For more reliable decarburization, it is necessary to raise the treatment temperature and prolong the treatment time, which produces the problem of scale formation and the resulting decrease in yield. Further, in all the production processes, no attempts have been made to improve the step of further cold working of the finishing-rolled mother pipe.

Therefore, recently, positive efforts have been made for the development of graphite-free lubricants and methods of using the same, in replacement of the above graphite-based lubricant, and Japanese Patent Application Publication No. 09-78080, for instance, discloses a lubricant which comprises, as main ingredients, layered oxides, namely mica, and a borate salt and is completely free of carbon or, if any, contains only the carbon in an organic binder component and thus has a carbon content lowered as far as possible.

The method of applying this graphite-free lubricant is the same as in the case of graphite-based lubricants, and the composition of the lubricant is designed so that the lubricant performance thereof may be equal to that of graphite-based lubricants. Thus, the graphite-free lubricant disclosed in Japanese Patent Application Publication No. 09-78080, when used properly, can prevent the carburized layer formation in the pipe inner surface.

On the actual premises operation, however, the mandrel bar surface is often contaminated with graphite.

Graphite-free lubricants are more expensive than graphite-based lubricants. Therefore, in the case of production of carbon steel pipes or low alloy steel pipes by elongating rolling using a mandrel bar, for example mandrel mill rolling, where no carburized layer is formed in the inner surface or a carburized layer, if formed, will not cause any particular problem, graphite-based lubricants are used from the economical viewpoint.

As a result, when a mandrel bar that has been used in elongating rolling of carbon steel pipes or low alloy steel pipes is used in producing stainless steel pipes, graphite inevitably remains adhering to the surface of that mandrel bar.

The graphite applied to the mandrel bar surface in elongating rolling of carbon steel pipes or low alloy steel pipes is spread abundantly on the mandrel bar transfer line, in particular the transfer line between the lubricant application area and the area of mandrel bar insertion into the hollow shell.

Therefore, even when a graphite-free lubricant is applied to the surface of the mandrel bar for using the same in elongating rolling of stainless steel pipes, the surface thereof (namely, the surface of the graphite-free lubricant film) is partly contaminated with the graphite already spread on the transfer line, irrespective of whether the mandrel bar has been submitted to elongating rolling of carbon steel pipes or low alloy steel pipes or not.

This graphite partly adhering to the graphite-free lubricant film surface comes into direct contact with the workpiece, namely the hollow shell; this causes the formation of a partially carburized layer in the pipe inner surface after rolling. Thus, the formation of a carburized layer is caused although there is a difference in extent as compared with the case of using a graphite-based lubricant.

On the other hand, in cases where a mandrel bar submitted to elongating rolling of carbon steel pipes or low alloy steel pipes is used, graphite remains adhering thereto beneath the graphite-free lubricant film newly applied and, as a result of severe working on an elongating rolling mill, the graphite remaining beneath the film also occasionally comes into direct contact with the workpiece and causes the formation of a partial carburized layer in the pipe inner surface during rolling and in the subsequent steps.

In this way, even when a graphite-free lubricant is used in elongating rolling using a mandrel bar, a carburized layer is formed in the pipe inner surface, and the carburized layer is selectively corroded in the descaling step comprising pickling of hot-finished pipes or pickling prior to cold working, resulting in surface roughening. The roughened surface caused by pickling remains, for example, in the form of pipe inner surface streak flaws even after cold working, thus deteriorating the surface quality.

DISCLOSURE OF INVENTION

As mentioned above, in cases where the formation of a carburized layer in the inner surface of a hot-finished pipe or a mother pipe to be cold-worked is allowed during elongating rolling using a mandrel bar and in the subsequent step, a problem arises, namely the stainless steel pipe thus made cannot be shipped as a product in as-is condition; the development of countermeasures for overcoming such problem has been demanded.

Further, when stretch reducer rolling is applied as sizing rolling in the conventional process for stainless steel pipe production, the finishing temperature tends to become low, and the working load in cold working then becomes high as a result of the increase in strength of the mother pipe to be cold-worked; therefore, after rolling of the mother pipe to be cold-worked, heat treatment is required for annealing the mother pipe at a stage prior to cold working.

Consequently, an increase in energy cost and a decrease in yield due to scale loss are incurred. Accordingly, the omission of the mother pipe annealing heat treatment as deemed essential prior to cold working is also sought after.

The present invention is to meet these demands and an object thereof is to provide a process for producing stainless steel pipes excellent in surface quality according to which the formation of a carburized layer in the inner surface of the finishing rolling blank pipe can be suppressed in the production of stainless steel pipes containing, by mass %, Cr: 10-30% by means of elongating rolling using a mandrel bar coated with a graphite-free lubricant and, further, the annealing heat treatment prior to cold working of the mother pipe, which is finishing-rolled by stretch reducer rolling as sizing rolling, can be omitted.

To accomplish the above object, the present inventors made detailed investigations concerning the conditions of carburized layer formation in the inner surface of the hot-finished pipes or mother pipes to be cold-worked as obtained by mandrel mill rolling using a graphite-free lubricant and in the inner surface of the pipes obtained by the subsequent cold working, when stainless steel pipes are produced by piercing rolling, elongating rolling using a mandrel bar such as mandrel mill rolling, and sizing rolling such as stretch reducer rolling.

More specifically, test steel grades (medium C content steel grades) based on SUS 304 steel and SUS 316 steel (upper limit of C content: 0.08% by mass) prescribed in certain Japanese Industrial Standards (JISs) with the C content adjusted to 0.05-0.08% by mass were used as raw material; they were rolled in the manner of mandrel mill rolling using a graphite-free lubricant and then reheated and subjected to stretch reducer rolling, and C concentration measurements on the inner surface and at subsurface portions away from the inner surface of the mother pipes obtained were carried out.

In the above measurements, the C concentration in the pipe inner surface after removal of adhering foreign substances such as oxide scale therefrom was determined by measuring the C concentration using an emission spectrophotometer. The C concentrations at subsurface portions away from the pipe inner surface were determined by successively removing layer by layer after oxide scale removal by grinding at a predetermined pitch and subjecting the newly formed face each time to C concentration determination using an emission spectrophotometer of the same type; the C concentrations at respective positions corresponding to the predetermined pitch in a thickness-wise direction were determined by repeating the above procedure.

FIG. 1 is a graphic representation of the distribution of C contents (or C concentrations) in the inner surface of blank pipes obtained by using, as raw material, a SUS 304 steel with the C content adjusted to 0.05-0.08% by mass and subjecting the material to mandrel mill rolling using a graphite-free lubricant. FIG. 2 is a graphic representation of the distribution of C contents (or C concentrations) in the inner surface of blank pipes obtained by using, as raw material, a SUS 316 steel with the C content adjusted to 0.05-0.08% by mass and subjecting the material to mandrel mill rolling using a graphite-free lubricant.

As shown in FIG. 1 and FIG. 2, carburized layers high in C concentration are formed in the inner surface of the mother pipes that were subjected to stretch reducer rolling following mandrel mill rolling due to the residual graphite adhering to the mandrel bar and production lines even when a graphite-free lubricant is used in mandrel mill rolling. The carburized layer depth reaches about 200 μm, and the C concentration in the carburized layer is higher by a maximum of about 0.015% by mass than the C content in the matrix of test steel grades. Further, the carburized layers contain carbide precipitates, mainly $M_{23}C_6$.

As regards the carbide precipitates in the carburized layer, when reheating prior to stretch reducer rolling is carried out in a state of occurrence of a carburized layer in the pipe inner surface after mandrel rolling, the supply of oxygen into the pipe becomes insufficient and graphite is burned incompletely, so that the partial pressure of CO in the pipe increases and the phenomenon of carburization advances. As a consequence of this, the carburized layer presumably becomes deeper and, at the same time, the C concentration also becomes higher and the amount of the carbide precipitates, mainly $M_{23}C_6$, increases.

Further, for suppressing the precipitation of carbides also in the case of using a stretch reducer-rolled and hot-finished pipe as a mother pipe to be cold-worked, attempts were also made to diffuse [C] in the carburized layer and to convert the carburized layer remaining in the pipe inner surface to scale in the annealing heat treatment of the mother pipe after stretch reducer rolling, and then, to remove such part by pickling for descaling, which is carried out as a pretreatment prior to cold working of the hot-finished pipe.

However, for causing [C] in the carburized layer to be diffused and converting the carburized layer to scale in the annealing heat treatment of the mother pipe, it is necessary to increase the heating temperature and prolong the heating time; as a result, the energy cost increases and the product yield drops due to scale loss and, further, the necessity of a prolonged period of time for the mother pipe heat treatment reduces the productivity.

The amount of carbides, mainly $M_{23}C_6$, which precipitate out in the carburized layer in the pipe inner surface increases as the C concentration in the carburized layer increases. In descaling by pickling, which is carried out as a pretreatment prior to cold working, the surface of the mother pipe to be cold-worked readily becomes roughened due to the carbides that have precipitated out in the vicinity of the surface layer on the pipe inner surface.

In particular, when no mother pipe annealing heat treatment is carried out, the diffusion of [C] in the carburized layer will not occur and the precipitation of carbides, mainly $M_{23}C_6$, cannot be suppressed, so that pickling for descaling makes it easier for the inner surface of the mother pipe to be cold-worked to undergo surface roughening with carbides in the pipe inner surface acting as starting points. Therefore, it is estimated that the roughened inner surface turns into streak flaws during the subsequent cold working which stay in place to the end as being the final product, markedly deteriorating the quality of the product.

The present inventors made further detailed investigations concerning the conditions of carburized layer formation in the inner surface of the hot-finished pipes or mother pipes to be cold-worked as obtained by mandrel mill rolling, followed by reheating and stretch reducer rolling. As a result, the inventors paid attention to the fact that, even in the case of mandrel mill rolling using a graphite-free lubricant, blowing an oxidizing gas into the inside of the finishing rolling blank pipes in a reheating furnace is effective to reduce the precipitation of carbides, mainly $M_{23}C_6$, in the inner surface of the hot-finished pipes or mother pipes to be cold-worked.

FIG. 3 is a graphic representation of the distribution of C contents (or C concentration) in the inner surface of mother pipes made of SUS 304 stainless steel as raw material by mandrel mill rolling using a graphite-free lubricant and then carrying out heat treatment in a reheating furnace while blowing air (oxidizing gas) into the inside of the mother pipes to be finishing-rolled, followed by stretch reduce rolling. FIG. 4 is a graphic representation of the distribution of C contents (or C concentrations) in the inner surface of mother pipes made of SUS 316 stainless steel as raw material in the same manner as in the case shown in FIG. 3 by mandrel mill rolling, heat treatment in a reheating furnace and stretch reducer rolling.

FIG. 5 is a representation illustrating a method of blowing air, as an oxidizing gas, into the inside of mother pipes to be finishing-rolled in the heat treatment in a reheating furnace. For blowing air, as an oxidizing gas, into the inside of mother pipes 1 to be finishing-rolled in the reheating furnace 2, air blowing nozzles 3 are provided on a side wall of the reheating furnace 2 and air is blown, via the nozzles 3, toward the pipe end of and into the inside of each finishing rolling blank pipe 1 that is heated to temperatures at 1000° C. or more in the reheating furnace 2 and conveyed sideways.

For realizing an oxidizing atmosphere in the blank pipe inside during reheating by blowing air into the inside of each finishing rolling blank pipe, the air blowing was carried out under the following standard conditions: air flow rate R of 4 liters/second; air blowing time t of 5 minutes (300 seconds). The finishing rolling blank pipe being treated under such air blowing conditions were subjected to stretch reducer rolling, and the thus-produced plurality of pipes were measured for the C concentrations in their inner surfaces. The conditions used in measuring the C concentrations in the inner surface of each mother pipe obtained by stretch reducer rolling were the same as in the cases shown in FIG. 1 and FIG. 2.

In FIG. 3 and FIG. 4, referred to above, each broken line indicates the C content in the middle of the wall thickness of mother pipes after stretch reducer rolling. Thus, it is seen that, as a result of blowing air, as an oxidizing gas, into the inside of finishing rolling blank pipes as heated to temperatures at 1000° C. or more in a reheating furnace under the conditions of an air flow rate R of 4 liters/second and an air blowing time t of 5 minutes (300 seconds), the C concentrations in the mother pipe inner surface arrived at levels causing almost no problems and, in the majority of mother pipes, complete decarburization was attained, although a maximum increase in C concentration of about 0.005% by mass was found compared with the C contents in the middle of the wall thickness of mother pipes.

The C contents (C concentrations) in the mother pipe inner surface as shown in FIG. 3 and FIG. 4, referred to above, indicate that significant reductions thereof can be attained by heating the finishing rolling blank pipes to 1000° C. or more in a reheating furnace and blowing an oxidizing gas into the inside thereof to realize an oxidizing atmosphere in the blank pipe inside during reheating, thereby ensuring full combustion of C.

In this way, by reducing the C contents in the inner surface of the finishing rolling blank pipe and eliminating high C concentration portions by heating in a reheating furnace, it becomes possible to inhibit the absolute C concentration values in the carburized layer from rising and prevent the precipitation of $M_{23}C_6$ carbides in the carburized layer in the mother pipe inner surface. Accordingly, the occurrence of streak flaws on the pipe inner surface after cold working can be inhibited even when the mother pipe annealing heat treatment is omitted, without causing surface roughening in pickling of hot-finished pipes or in pickling for descaling, which is carried out as a pretreatment prior to cold working.

In the conventional processes for producing stainless steel pipes, the mother pipe annealing heat treatment prior to cold working is employed as an essential step and, in cases where stretch reducer rolling is applied as sizing rolling on the basis of such premise, no strict temperature control is carried out with regard to the finishing temperature in stretch reducer rolling and the temperature is generally controlled within the range of 750-850° C., which is regarded as the temperature range in which stretch reducer rolling is possible.

However, as shown in FIG. 7 described later, according to the results of investigations made by the present inventors, the mother pipe annealing heat treatment prior to cold working as so far regarded as essential in producing stainless steel pipes can be omitted when the finishing temperature in stretch reducer rolling is strictly controlled within the narrow range of 860-1050° C. on the higher temperature side as compared with the range so far employed.

Furthermore, the descalability in pickling to be carried out as a pretreatment prior to cold working can also be improved by strictly controlling the finishing temperature in stretch reducer rolling on the higher temperature side. It was thus found that, even when the mother pipe annealing heat treatment is omitted, no prolonged descaling time is required and the time required therefor remains at the same level as required for pickling after the conventional annealing heat treatment.

The present invention relates to a process for producing stainless steel pipes made of stainless steel as raw material by piercing rolling, elongating rolling using a mandrel bar and sizing rolling and to a process for cold working the stainless steel pipes and, more particularly, it relates to a process for producing stainless steel pipes according to which even when a graphite-free lubricant is used, the inner surface carburization to be generated in the step of elongating rolling using a mandrel bar such as mandrel mill rolling can be inhibited and, when the steel pipe thus made is used as a mother pipe and subjected to cold working, the annealing heat treatment thereof prior to cold working can be omitted.

The process for stainless steel pipe production according to the present invention is based on the results of the detailed investigations as described above and is a process for producing stainless steel pipes which comprises subjecting a stainless steel as raw material containing, by mass, Cr: 10-30% to piercing rolling to yield a hollow shell, subjecting the hollow shell to elongating rolling using a mandrel bar with a graphite-free lubricant to make a finishing rolling blank pipe, and heating the blank pipe thus made in a reheating furnace and subjecting the same to finishing rolling by sizing rolling and, further, is a process for stainless steel pipe production which comprises subjecting the pipe obtained in the above manner, as a mother pipe, to cold working, in which the carburized layer formation in the pipe inner surface can be inhibited by heating the above-mentioned finishing rolling blank pipe to a temperature of 1000° C. or more in the above-mentioned reheating furnace while blowing an oxidizing gas into the inside thereof.

Furthermore, by carrying out the finishing rolling in the by means of stretch reducer rolling as sizing rolling within the temperature range of 860-1050° C. in accordance with the process for stainless steel pipe production according to the present invention, it becomes possible to carry out the cold working while omitting the mother pipe annealing heat treatment.

In the process for stainless steel pipe production according to the present invention, it is desirable that the air flow rate R (liters/second) and the air blowing time t (seconds) on the occasion of blowing air as an oxidizing gas into the inside of the finishing rolling blank pipe in the reheating furnace satisfy the conditions represented by the following formula (1):

$$240 \leqq R \times t \leqq 2100 \quad (1)$$

The "elongating rolling using a mandrel bar" so referred to herein is not limited to mandrel mill rolling mentioned above by way of example but includes rolling methods comprising carrying out elongating rolling with a mandrel bar inserted into the inside of a hollow shell produced by piercing rolling, such as Pilger mill rolling or Assel mill rolling, as well. In each case, the problem of carburization in the pipe inner surface arises due to the lubricant applied to the mandrel bar surface.

Further, the "sizing rolling" so referred to herein is a rolling operation for adjusting the external shape, wall thickness of the finishing rolling blank pipe as obtained by the above "elongating rolling using a mandrel bar" to the desired dimensions; stretch reducer rolling and sizer rolling correspond thereto.

By carrying out elongating rolling using a mandrel bar, such as mandrel mill rolling, using a graphite-free lubricant and carrying out heating in the reheating furnace while blowing an oxidizing gas into the pipe inside in accordance with the process for stainless steel pipe production according to the present invention, the carburized layer formation in the pipe inner surface to be generated in the subsequent sizing rolling can be inhibited. Furthermore, by controlling the finishing temperature in stretch reducer rolling as sizing rolling, the mother pipe annealing heat treatment prior to cold working can be omitted and, thus, cold-worked products excellent in surface quality can be obtained with high production efficiency.

BRIEF DESCRIPTION OF THE DRAWINGS

FIG. 6 is a representation illustrating the process for stainless steel pipe production according to the present invention. FIG. 6 (*a*) shows the process for producing hot-finished pipes and FIG. 6 (*b*) shows the process for producing cold-finished pipes.

FIG. 7 is a graphic representation of the relationship between the finishing temperature in stretch reducer rolling and the tensile test results. FIG. 7 (*a*) shows the results of yield strength measurements and FIG. 7 (*b*) shows the results of tensile strength measurements.

BEST MODES FOR CARRYING OUT THE INVENTION

Figure 1:
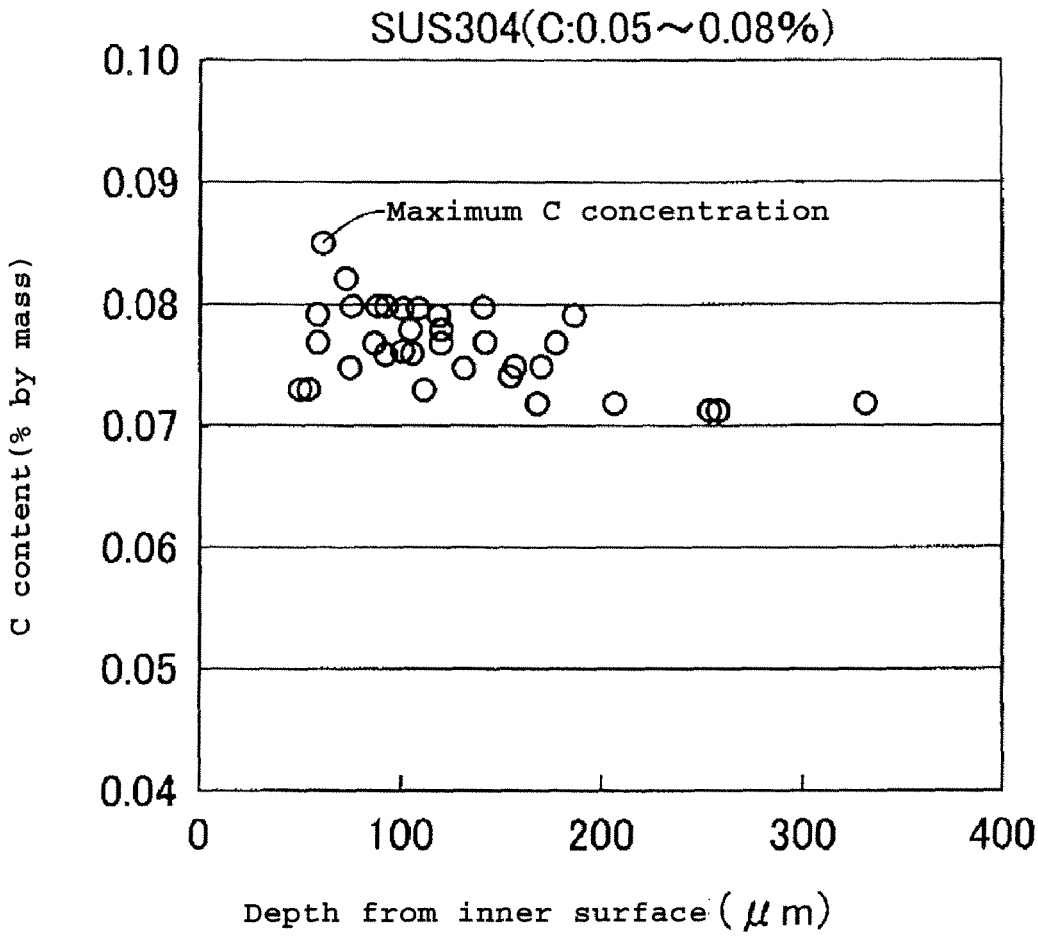
FIG. 1 is a graphic representation of the distribution of C contents (or C concentrations) in the inner surface of blank pipes obtained by: using SUS 304 steel as raw material with the C content adjusted to 0.05-0.08% by mass; and subjecting the material to mandrel mill rolling using a graphite-free lubricant.
Figure 2:
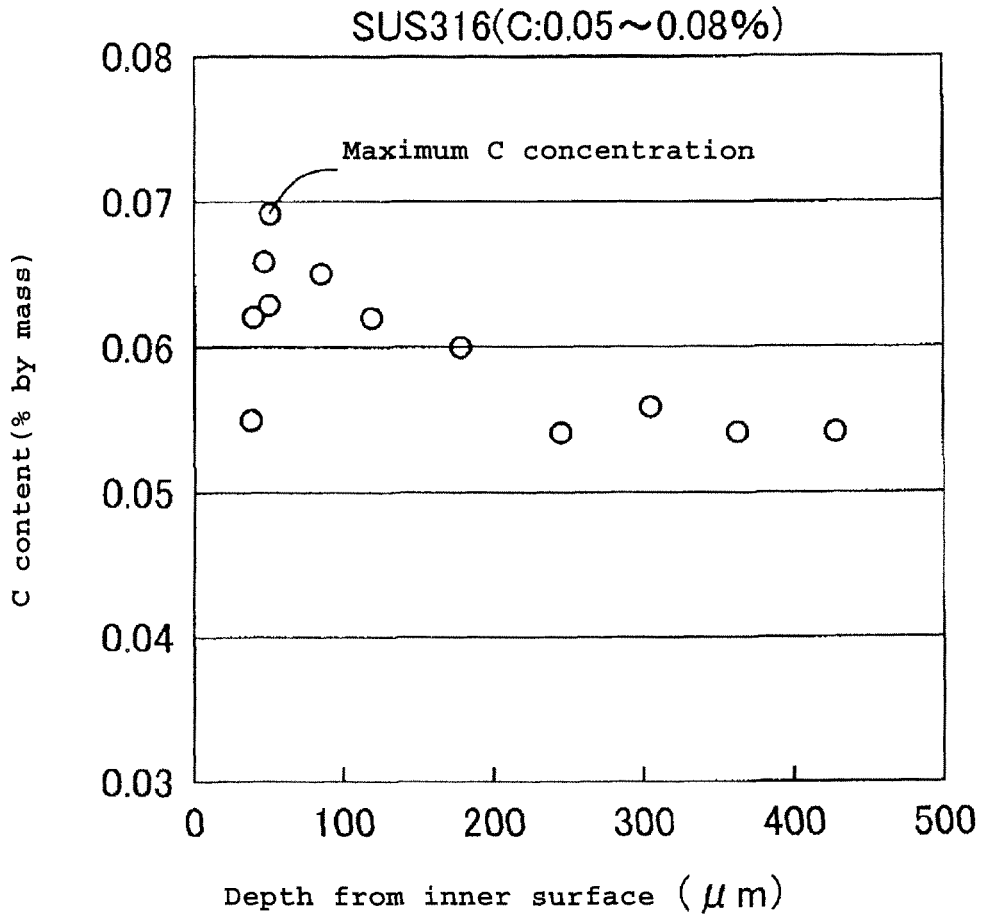
FIG. 2 is a graphic representation of the distribution of C contents (or C concentrations) in the inner surface of blank pipes obtained by: using SUS 316 steel as raw material with the C content adjusted to 0.05-0.08% by mass; and subjecting the material to mandrel mill rolling using a graphite-free lubricant.

FIG. 6 is a representation illustrating the process for stainless steel pipe production according to the present invention. FIG. 6 (*a*) shows the process for producing hot-finished pipes and FIG. 6 (*b*) shows the process for producing cold-finished pipes. In billet heating, a starting material, namely a round steel block (billet) is generally heated to 1150-1250° C. using a heating furnace such as a rotary hearth type, and then, in piercing rolling, the billet is shaped into a hollow shell using an inclined roll piercing/rolling machine, typically a Mannesmann piercer.

In elongating rolling using a mandrel bar such as mandrel mill rolling, a mandrel bar coated with a graphite-free lubricant is inserted into the hollow shell thus obtained, and the hollow shell is roughening-rolled to give a finishing rolling blank pipe with predetermined dimensions. After this roughening rolling, the finishing rolling blank pipe is heated, in a reheating furnace, to 1000° C. or more for annealing the pipe while blowing an oxidizing gas into the blank pipe inside and, in the subsequent sizing rolling (e.g. stretch reducer rolling), the blank pipe is finishing-rolled where an outside diameter reduction and a slight extent of wall thickness reduction undergo to thereby give a hot-finished pipe or a mother pipe to be cold-worked, each having predetermined dimensions.

In carrying out heating in the reheating furnace while an oxidizing gas is blown into the pipe inside, the oxidizing gas is desirably blown into the inside of the finishing rolling blank pipe at a predetermined flow rate (liters/second) for a predetermined blowing time (seconds) so that the decarburizing effect may be produced effectively.

As shown in FIG. 6 (*a*), as a hot-rolled and hot-finished pipe, solution heat treatment as a final heat treatment or pickling treatment is applied to yield a product pipe. In the cold-finished pipe production process shown in FIG. 6 (*b*), the hot-rolled mother pipe to be cold-worked, after annealing heat treatment, if necessary, is subjected to pickling for descaling and the scale on the outer and inner surfaces of the mother pipe are thereby removed. In cases where stretch reducer rolling is applied as sizing rolling and the annealing heat treatment at the mother pipe stage is omitted, the pipe is directly subjected to pickling and the outer and inner surface scale of the mother pipe are removed. Thereafter, in the cold working, the mother pipe is subjected to cold drawing using a die alone or using a die and a plug and/or to cold rolling using a cold Pilger mill to thereby get processed to product dimensions and then subjected to solution heat treatment and/or pickling treatment as a final treatment to give a cold-finished product pipe.

In cases where stretch reducer rolling is applied as sizing rolling, it is desirable that the finishing temperature in stretch reducer rolling be controlled within the range of 860-1050° C. so that the annealing heat treatment of the mother pipe to be cold-worked may be omitted.

In cases where the annealing heat treatment of the mother pipe to be cold-worked is omitted, one-pass cold working may accompany a high reduction rate in some cold working schedules and, therefore, it becomes sometimes necessary to carry out plural-pass cold working. In such cases, the mother pipe annealing heat treatment is omitted but the workpiece is sometimes subjected to heat treatment for annealing in an intermediate step between cold working and then further cold-worked and, after final finishing cold working, is subjected to solution heat treatment and/or picking treatment as a final treatment to give a cold-finished product pipe.

The Cr content of the stainless steel as raw material in the production process according to the present invention is restricted since, at Cr content levels below 10% by mass, the desired level of corrosion resistance cannot be secured and, at content levels exceeding 30% by mass, the effect has already arrived at a saturation level and the cost alone increases. Therefore, the Cr content in the stainless steel as raw material should be 10-30% by mass.

As examples of the stainless steel as raw material in the production process according to the present invention, there may be mentioned those stainless steels prescribed in certain Japanese Industrial Standards (JISs), for example SUS 405, SUS 410, SUS 430, SUS 304, SUS 309, SUS 310, SUS 316, SUS 347, SUS 329 J1, NCF 800 and NCF 825 stainless steels, and alloy steels corresponding thereto.

As examples of the graphite-free lubricant which can be employed in the production process according to the present invention, there may be mentioned (a) composite lubricants composed, with arbitrary proportion in mixture, of: one or more granular layer-like oxides selected from a group consisted of artificial micas and natural micas such as potassium tetrasilic mica, sodium tetrasilic mica, natural phlogopite, bentonite, montmorillonite and vermiculite; boron oxide; boric acid; alkali metal berates; sodium carbonate; potassium carbonate; sodium silicate; and potassium silicate, (b) lubricants mainly composed of boron nitride (BN), and (c) lubricants mainly composed of silicate glass and borosilicate glass.

The reason why the finishing rolling blank pipe is heated at 1000° C. or more in a reheating furnace in the production process according to the present invention is that when the heating temperature is below 1000° C., the decarburization in the inner surface of the finishing rolling blank pipe becomes insufficient even when a sufficient amount of an oxidizing gas is blown into the pipe inside. While it is not necessary to prescribe any upper limit to the heating temperature, the heating temperature is desirably not more than 1200° C. since, at heating temperatures exceeding 1200° C., the scale formation increases rapidly, causing the product yield problem due to scale loss.

Figure 3:
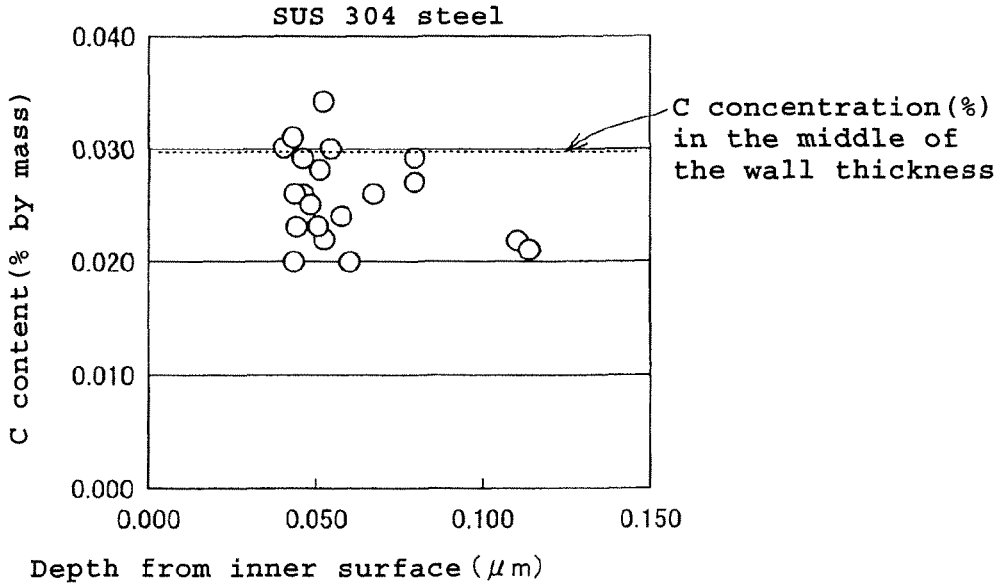
FIG. 3 is a graphic representation of the distribution of C contents (or C concentration) in the inner surface of blank pipes made of SUS 304 stainless steel as raw material by mandrel mill rolling using a graphite-free lubricant and then carrying out heating in a reheating furnace while blowing air (oxidizing gas) into the inside of the finishing rolling blank pipes, followed by stretch reduce rolling.
Figure 4:
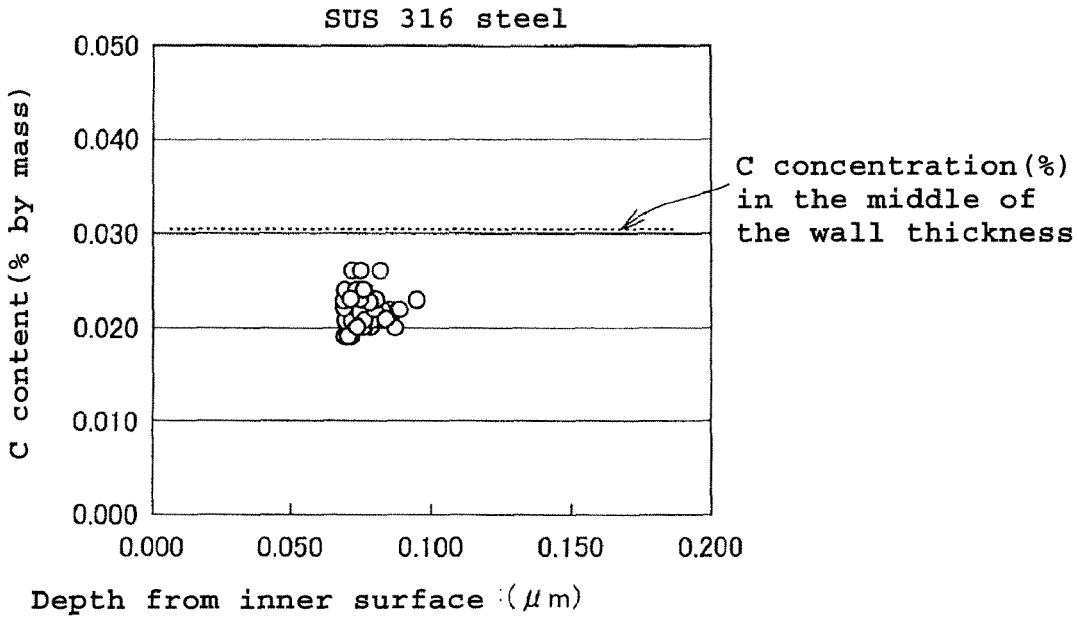
FIG. 4 is a graphic representation of the distribution of C contents (or C concentrations) in the inner surface of blank pipes made of SUS 316 stainless steel as raw material by mandrel mill rolling using a graphite-free lubricant and then carrying out heating in a reheating furnace while blowing air (oxidizing gas) into the inside of the finishing rolling blank pipes, followed by stretch reducer rolling.

In the production process according to the present invention, it is essential to carry out heating which comprises heating the finishing rolling blank pipe to a temperature of 1000° C. or more in a reheating furnace while blowing an oxidizing gas into the inside thereof. Although in cases where elongating rolling is carried out using a graphite-free lubricant, carburization still remains in the inner surface of the finishing rolling blank pipe, the maximum C concentration in the inner surface thereof can be lowered, even in that case, by the decarburizing action of the oxidizing gas blown thereinto, as shown in FIG. 3 and FIG. 4 referred to hereinabove.

Usable as the oxidizing gas to be applied in the production process according to the present invention are such gases as air, oxygen ($O_2$), carbon dioxide ($CO_2$) and steam ($H_2O$) as well as mixed gases composed of one or more of these and non-oxidizing gas such as hydrogen, nitrogen, or rare gas. From the sourcing cost and/or easy handling viewpoint, the use of air as the oxidizing gas is desirable.

Although the decarburizing effect can be produced even when the amount of an oxidizing gas blown into the blank pipe inside in carrying out the decarburization in the inner surface of the finishing rolling blank pipe, it is desirable in the case of using air as the oxidizing gas that the conditions represented by the following formula (1) be satisfied so that the decarburizing effect of the oxidizing gas may be effectively achieved:

$$240 \leqq R \times t \leqq 2100 \quad (1)$$

where R is the air flow rate (liters/second) and t is the air blowing time (seconds).

According to the results of investigations made by the present inventors, it is necessary, for reducing the C concentration in the blank pipe inner surface to a level equivalent to the C concentration in the base material (C content in the middle of the wall thickness), to carry out the decarburization to a sufficient extent such that the amount of the oxidizing gas blown into the blank pipe {R (liters/second)×t (seconds)} may amount to at least 240 (liters).

On the other hand, when the amount of the oxidizing gas blown {R (liters/second)×t (seconds)} is in excess of 2100 (liters), the scale formation on the blank pipe inner surface is promoted and the scale loss becomes increased. Furthermore, it is feared that the temperature of the finishing rolling blank pipe be lowered by the air blown thereinto and the reheating become insufficient and the strength of the workpiece pipe in the subsequent stretch reducer rolling become excessively high, requiring an increased rolling load and possibly causing such troubles as rolling roll failures. It has been confirmed that when the blowing amount is not more than 2100 (liters), the lowering of the temperature of the finishing rolling blank pipe remains within 5° C. and the finishing temperature in stretch reducer rolling will never be affected.

In the production process according to the present invention in which stretch reducer rolling is applied as sizing rolling, the finishing temperature in the stretch reduce rolling should be 860° C. or more. If that temperature is less than 860° C., the mother pipe will be softened to an insufficient extent, so that axial inner surface cracks or other work-related flaws will be caused readily in the subsequent cold working; accordingly, no sufficient workability can be secured. Furthermore, fine scale is found formed on the mother pipe surface after stretch reducer rolling, making it difficult to remove the scale in the step of descaling by picking, which is carried out as a pretreatment prior to cold working, and prolonging the pickling time.

Further, by controlling the finishing temperature in stretch reducer rolling at a level of 860° C. or more, it becomes possible to reduce the yield strength of the stretch reducer-rolled mother pipe to a level at which cold working thereof is possible.

On the other hand, the finishing temperature in stretch reducer rolling should be not more than 1050° C. This is because even when that temperature is more than 1050° C., the extent of softening of the rolled mother pipe is not so affected but, conversely, scale is formed very abundantly, so that not only the product surface quality is impaired but also the product yield is reduced due to scale loss. Considering the workability in cold working and the product surface quality, it is recommended that the finishing temperature in stretch reducer rolling be controlled within the range of 870-1000° C., more desirably strictly within the range of 900-1000° C.

EXAMPLES

Example 1

In Example 1, two SUS 304 steel grades having the respective compositions shown in Table 1 were prepared as raw material stainless steel to be rolled.

TABLE 1

| Steel | Chemical composition (% by mass, the remainder being Fe and impurities) | | | | | | | | JIS |
|---|---|---|---|---|---|---|---|---|---|
| grades | C | Si | Mn | P | S | Ni | Cr | Mo | designation |
| A | 0.03 | 0.30 | 1.85 | 0.020 | 0.003 | 8.2 | 18.2 | 0.09 | SUS304 |
| B | 0.10 | 0.28 | 1.80 | 0.018 | 0.002 | 8.0 | 18.1 | 0.10 | SUS304 |

A mandrel bar having an outside diameter of 94.5 mm and having a film, about 100 μm in thickness, of a graphite-free lubricant prepared by mixing sodium tetrasilic mica and a boric acid salt in a proportion of 1:1 as applied by brushing at room temperature, followed by drying, was prepared.

Then, using this mandrel bar with the graphite-free lubricant film formed thereon, hollow shells of the two steel grades mentioned above as obtained by piercing/rolling on an inclined roll piercing/rolling machine, the hollow shells each having an outside diameter of 136.0 mm, a wall thickness of 16.8 mm, a length of 7700 mm and a temperature of 1100° C., were passed through a mandrel mill consisting of seven stands to give roughening-rolled finishing rolling blank pipes, 110.0 mm in outside diameter, 5.8 mm in wall thickness and 25600 mm in length.

Figure 5:
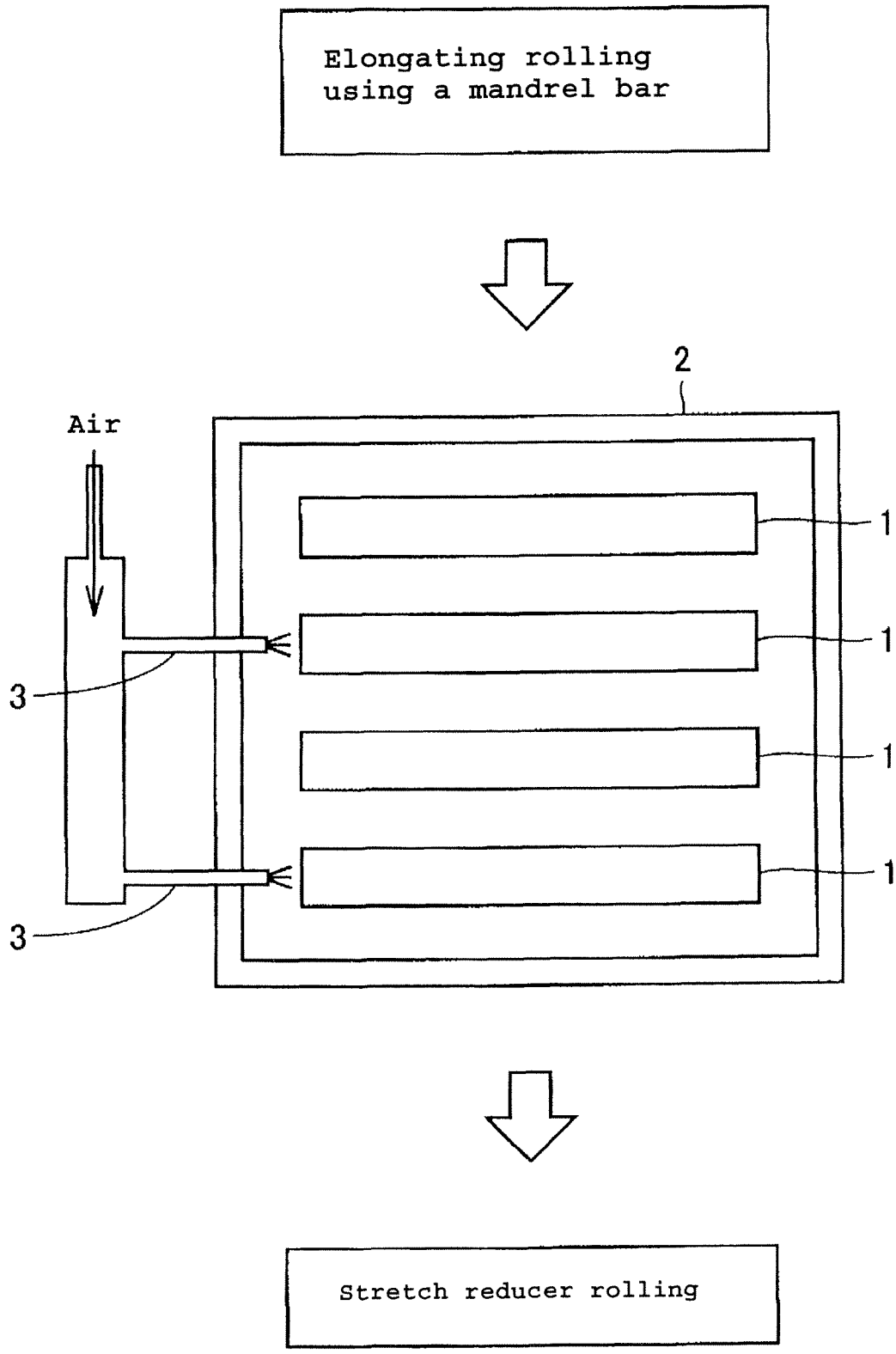
FIG. 5 is a representation illustrating a method of blowing air, as an oxidizing gas, into the inside of finishing rolling blank pipes in heating in a reheating furnace.

Subsequently, in reheating the blank pipes obtained by mandrel mill rolling, the apparatus configuration shown in FIG. 5 referred to hereinabove was employed, air blowing nozzles 3 were disposed on a side wall of a reheating furnace 2, and air, as an oxidizing gas, was blown, from the air blowing nozzles 3, through the pipe end and into the inside of each finishing rolling blank pipe 1 which is heated in the reheating furnace 2 and being transferred sideways. The amount of blown air was varied within the range of 0-3600 (liters) by varying the air flow rate R (liters/second) and the air blowing time t (seconds).

After reheating, each pipe was fed to a stretch reducer comprising 26 stands and rolled to give a mother pipe to be cold-worked (hot-finished pipe) with an outside diameter of 45.0 mm, a wall thickness of 5.0 mm and a length of 76000 mm; the finishing temperature was 900-1000° C. The thus-rolled mother pipe, after cooling to room temperature and cutting off of crops, was divided by cutting into five segments each having a length of 14000 mm. The inner surface of each of the thus-obtained mother pipes to be cold-worked was examined for the state of carburization (C concentration in the mother pipe inner surface) and the state of surface roughening after pickling. The results thus obtained are shown in Table 2.

As mentioned hereinabove, the C concentration in the mother pipe inner surface was determined, after complete removal of foreign substances, such as oxide scale, adhering to the inner surface, by measuring the C concentration using an emission spectrophotometer, and the difference ΔC (% by mass) from the C content in the middle of the base material wall thickness was reported. Further, after pickling by 60 minutes of immersion of the mother pipe in a nitric hydrofluoric acid solution, the mother pipe inner surface quality was observed by the eye and evaluated in terms of the state of surface roughening.

TABLE 2

| | | | Air blowing conditions | | | Inner surface quality conditions | | |
|---|---|---|---|---|---|---|---|---|
| Test No. | Steel grades | Heating temperature in reheating furnace | Flow rate R (l/sec) | Time t (seconds) | Blown air amount (l) | ΔC (% by mass) | Surface condition after pickling | Remark |
| 1 | A | 1050 | — | — | *0 | 0.015 | Surface roughening found | Comparative example |
| 2 | A | 1050 | 4 | 30 | 120 | 0.0125 | Slight surface roughening | Inventive example |
| 3 | A | 1050 | 4 | 60 | 240 | 0.009 | No surface roughening | Inventive example |
| 4 | A | 1050 | 4 | 480 | 1920 | 0.007 | No surface roughening | Inventive example |
| 5 | B | 1050 | — | — | *0 | 0.015 | Surface roughening found | Comparative example |
| 6 | B | 1050 | 4 | 60 | 240 | 0.010 | No surface roughening | Inventive example |
| 7 | B | 1050 | 4 | 480 | 1920 | 0.009 | No surface roughening | Inventive example |
| 8 | A | *950 | 4 | 900 | 3600 | 0.015 | Surface roughening found | Comparative example |
| 9 | A | 1000 | 4 | 60 | 240 | 0.010 | No surface roughening | Inventive example |
| 10 | A | 1100 | 4 | 300 | 1200 | 0 | No surface roughening | Inventive example |

Notes:
In the table, the mark * indicates that the value is outside the respective range defined in accordance with the present invention.
In the table, the flow rate R and the blown air amount are shown in terms of (liters/sec) and (liters), respectively.

As can be seen from the results given in Table 2, the mother pipe specimens resulting from heating at 1000° C. or more in the reheating furnace and blowing air, as an oxidizing gas, into the inner surface thereof gave reduced ΔC values (% by mass) and thus showed alleviations of carburization and were slight in inner surface roughening, as compared with the mother pipe specimens obtained without blowing air thereinto, in spite of the fact that the amount of blown air was small (e.g. Test No. 2).

As for the amount of blown air, the mother pipe specimens resulting from blowing air thereinto in an amount of not less than 240 (liters) by varying the air flow rate R (liters/second) and the air blowing time t (seconds) showed more reduced inner surface ΔC values (% by mass) and, at the same time, showed no surface roughening after pickling.

On the contrary, the mother pipe specimens obtained as comparative examples without blowing air thereinto showed remaining inner surface carburization and showed surface roughening resulting therefrom (Test Nos. 1 and 5). In the case of the mother pipe specimens for which the heating temperature in the reheating furnace was less than 1000° C., the decarburization in the mother pipe inner surface were not carried out to a sufficient extent but surface roughening was found (Test No. 8).

Example 2

The mother pipes to be cold-worked as produced in Test Nos. 4, 5 and 7 in Example 1, after confirmation of absence or presence of surface roughening at the mother pipe stage, were subjected to cold working. The mother pipe annealing heat treatment as a pretreatment prior to cold working was omitted, and the mother pipes with an outside diameter of 45.0 mm, a wall thickness of 5.0 mm cut into a length of 14000 mm, in as-is condition, were immersed in a nitric hydrofluoric acid solution for 60 minutes for effecting descaling by pickling.

The cold working was carried out by means of cold rolling. In the cold rolling, the mother pipes were finishing-rolled using a cold Pilger mill to an outside diameter of 25.4 mm and a wall thickness of 2.1 mm (reduction rate in area (Rd): 75%). The inner surface condition of each pipe after cold working was visually checked. The observation results at the mother pipe stage and after cold working are shown in Table 3.

TABLE 3

| Test No. | Steel grade | Blown air amount (liters) | Surface condition: Mother pipe stage | Surface condition: After cold working | Remark |
|---|---|---|---|---|---|
| 4 | A | 1920 | No surface roughening | No inner surface flaw | Inventive example |
| 5 | B | *0 (no blowing) | Surface roughening found | Streak flaws found | Comparative example |
| 7 | B | 1920 | No surface roughening | No inner surface flaw | Inventive example |

Note:
In the table, the mark * indicates that the value is outside the range defined in accordance with the present invention.

As is evident from the results shown in Table 3, surface roughening occurred at the mother pipe stage in the comparative example (Test No. 5) and, after cold working, streak flaws were found on the pipe inner surface. On the contrary, in the examples according to the present invention (Test Nos. 4 and 7), no surface roughening occurred even at the mother pipe stage and no occurrence of inner surface flaws was found on the pipe inner surface after cold working; thus, stainless steel pipes having good surface conditions were obtained.

Example 3

Both SUS 304 steel and SUS 316 steel grades having the respective compositions shown in Table 4 were prepared as raw material stainless steel to be rolled. As for the C contents in the test steel, four steel grades (C, D, E and F) where a C content level being varied to 0.02% and 0.04% (low C grades) and two steel grades (G and H) containing 0.05-0.08% of C (medium C grades) were prepared.

TABLE 4

| Steel grades | Chemical composition (% by mass; the remainder being Fe and impurities): C | Si | Mn | P | S | Ni | Cr | Mo | JIS designation |
|---|---|---|---|---|---|---|---|---|---|
| C | 0.026 | 0.28 | 1.89 | 0.026 | 0.001 | 8.15 | 18.32 | 0.09 | SUS304 |
| D | 0.039 | 0.33 | 1.75 | 0.025 | 0.004 | 8.09 | 18.01 | 0.10 | SUS304 |
| E | 0.022 | 0.32 | 0.97 | 0.030 | 0.001 | 11.09 | 16.21 | 2.13 | SUS316 |
| F | 0.040 | 0.30 | 1.81 | 0.034 | 0.003 | 10.22 | 16.30 | 2.15 | SUS316 |
| G | 0.072 | 0.24 | 1.85 | 0.034 | 0.002 | 8.08 | 18.70 | 0.19 | SUS304 |
| H | 0.055 | 0.25 | 1.72 | 0.032 | 0.005 | 10.04 | 16.07 | 2.12 | SUS316 |

A mandrel bar with an outside diameter of 94.5 mm was prepared and a film, about 100 μm in thickness, of a graphite-free lubricant composed of sodium tetrasilic mica and a boric acid salt compound, a mixture ratio of 1:1, was formed on the surface of the mandrel bar by brushing at room temperature, followed by drying.

Then, using this mandrel bar, hollow shells of 136.0 mm in outside diameter, 16.8 mm in wall thickness, 7700 mm in length and 1100° C. in temperature, which were obtained from the six steel grades specified in Table 4 by piercing/rolling on an inclined roll piercing/rolling machine, were passed through a mandrel mill comprising 7 stands and roughening-rolled into the finishing rolling blank pipes of 110.0 mm in outside diameter, 5.8 mm in wall thickness and 25600 mm in length. Thereafter, descaling was carried out by injecting high-pressure water jet thereon through an annular nozzle disposed in the inlet side vicinity.

Subsequently, the pipes obtained by mandrel mill rolling were reheated to 1100° C. and fed to a stretch reducer comprising 26 stands and rolled while the finishing temperature was varied within the range of 840-1050° C., to give mother pipes to be cold-worked, 45.0 mm in outside diameter, 5.0 mm in wall thickness and 76000 mm in length (reduction rate in area (Rd): 67%).

The mother pipes thus-rolled, after cooling to ambient temperature and cutting off crops, were divided by cutting into five segments of a length of 14000 mm. JIS No. 11 test specimens were taken from each mother pipe in a length-wise direction and were subjected to tensile testing for yield strength and tensile strength determinations.

FIG. 7 is a graphic representation of the relationship between the finishing temperature in stretch reducer rolling and the tensile test results. FIG. 7 (*a*) shows the results of yield strength measurements and FIG. 7 (*b*) shows the results of tensile strength measurements. The yield strength and tensile strength decreased with the increase in finishing temperature in stretch reducer rolling and, at finishing temperatures of 860° C. or more, the yield strength lowered to 600 MPa or less, which is a strength level enabling cold working (cold drawing and/or cold rolling).

With all grades of SUS 304 steel and SUS 316 steel, irrespective of whether they were low C grades or medium C grades, the finishing temperature had a great influence, leading to almost the same strength levels.

INDUSTRIAL APPLICABILITY

By carrying out elongating rolling using a mandrel bar, such as mandrel mill rolling, using a graphite-free lubricant and carrying out the heat treatment in the reheating furnace while blowing an oxidizing gas into the pipe inside in accordance with the process for producing stainless steel pipe according to the present invention, the carburized layer formation in the pipe inner surface to be occurred in the subsequent sizing rolling can be inhibited and, further, by controlling the finishing temperature in stretch reducer rolling as sizing rolling, the mother pipe annealing heat treatment prior to cold working can be omitted and, thus, cold-worked products excellent in surface quality can be obtained with high production efficiency. Accordingly, the production process according to the present invention can be widely applied as a process for producing hot-finished stainless steel pipes and further cold-worked stainless steel pipes.

What is claimed is:

1. A process for producing stainless steel pipes by subjecting a stainless steel raw material containing, by mass, Cr: 10-30%, to piercing rolling to give a hollow shell, subjecting the hollow shell to elongating rolling to give a finishing rolling blank pipe using a mandrel bar, together with a graphite-free lubricant, and heating the blank pipe in a reheating furnace and subjecting the heated blank pipe to finishing rolling by sizing rolling, wherein the finishing rolling blank pipe is subjected to heating in which it is heated to a temperature not less than 1000° C. in the reheating furnace and an oxidizing gas is blown into the inside of the finishing rolling blank pipe from one end thereof using a blowing nozzle such that combustion of C is fully promoted in the carburized layer in the inside of the finishing rolling blank pipe.

2. A process for producing stainless steel pipes according to claim 1, wherein air is the oxidizing gas blown into the inside of the finishing rolling blank pipe from one end thereof using a blowing nozzle in the reheating furnace and wherein the air flow rate R (liters/second) and the air blowing time t (seconds) of the air blown into the inside of the finishing rolling blank pipe satisfy the conditions specified by the following formula (1):

$$240 \leqq R \times t \leqq 2100 \quad (1)$$

wherein combustion of C is fully promoted in the carburized layer in the inside of the finishing rolling blank pipe.

3. A process for producing stainless steel pipes by subjecting a stainless steel raw material containing, by mass, Cr: 10-30%, to piercing rolling to give a hollow shell, subjecting the hollow shell to elongating rolling to give a finishing rolling blank pipe using a mandrel bar, together with a graphite-free lubricant, and heating the blank pipe in a reheating furnace and subjecting the heated blank pipe to finishing rolling to give a mother pipe by sizing rolling and subjecting the mother pipe to cold working, wherein the finishing rolling blank pipe is subjected to heating in which it is heated to a temperature not less than 1000° C. in the reheating furnace and an oxidizing gas is blown into the inside of the finishing rolling blank pipe from one end thereof using a blowing nozzle such that combustion of C is fully promoted in the carburized layer in the inside of the finishing rolling blank pipe.

4. A process for producing stainless steel pipes according to claim 3, wherein air is the oxidizing gas blown into the inside of the finishing rolling blank pipe from one end thereof using a blowing nozzle in the reheating furnace and wherein the air flow rate R (liters/second) and the air blowing time t (seconds) of the air blown into the inside of the finishing rolling blank pipe satisfy the conditions specified by the following formula (1):

$$240 \leqq R \times t \leqq 2100 \quad (1)$$

wherein combustion of C is fully promoted in the carburized layer in the inside of the finishing rolling blank pipe.

* * * * *

UNITED STATES PATENT AND TRADEMARK OFFICE

CERTIFICATE OF CORRECTION

PATENT NO. : 8,047,039 B2
APPLICATION NO. : 12/247923
DATED : November 1, 2011
INVENTOR(S) : Yasuyoshi Hidaka et al.

It is certified that error appears in the above-identified patent and that said Letters Patent is hereby corrected as shown below:

On the Cover Page:

Item (57), line 2, "piercing rolling" should be -- piercing and rolling --.

Signed and Sealed this
Twenty-third Day of October, 2012

David J. Kappos

David J. Kappos
*Director of the United States Patent and Trademark Office*